US008220435B2

(12) United States Patent
Shimizu et al.

(10) Patent No.: US 8,220,435 B2
(45) Date of Patent: Jul. 17, 2012

(54) ROTARY PISTON ENGINE AND METHOD FOR DESIGNING THE SAME

(75) Inventors: Ritsuharu Shimizu, Hiroshima (JP); Shinya Ueki, Hiroshima (JP)

(73) Assignee: Mazda Motor Corporation (JP)

( * ) Notice: Subject to any disclaimer, the term of this patent is extended or adjusted under 35 U.S.C. 154(b) by 921 days.

(21) Appl. No.: 12/250,796

(22) Filed: Oct. 14, 2008

(65) Prior Publication Data

US 2009/0101103 A1 Apr. 23, 2009

(30) Foreign Application Priority Data

Oct. 17, 2007 (JP) ..... 2007-270151

(51) Int. Cl.
*F02B 53/00* (2006.01)
*F03C 2/00* (2006.01)

(52) U.S. Cl. ..... 123/242; 123/200; 123/228

(58) Field of Classification Search ..... 123/242, 123/200, 228; 418/61.2
See application file for complete search history.

(56) References Cited

U.S. PATENT DOCUMENTS

| | | | | |
|---|---|---|---|---|
| 3,102,492 A | | 9/1963 | Bentele et al. | |
| 3,180,560 A | | 4/1965 | Paschke | |
| 3,196,849 A | | 7/1965 | Paschke | |
| 3,196,852 A | | 7/1965 | Bentele | |
| 3,276,676 A | | 10/1966 | Buske | |
| 3,441,007 A | * | 4/1969 | Kwaak | 123/242 |
| 3,793,996 A | * | 2/1974 | Scheerer | 123/205 |
| 3,941,526 A | * | 3/1976 | Kutkus | 418/61.2 |
| 4,756,284 A | * | 7/1988 | Okimoto et al. | 123/216 |
| 6,168,405 B1 | * | 1/2001 | Nosenchuck | 418/61.2 |

FOREIGN PATENT DOCUMENTS

| | | | |
|---|---|---|---|
| GB | 905308 | A | 9/1962 |
| JP | S53-8410 | A | 1/1978 |
| JP | S63-100227 | A | 5/1988 |
| JP | S64-036929 | A | 2/1989 |
| JP | 07-011969 | | 7/1993 |
| JP | 05-202761 | | 10/1993 |
| JP | 2004-116492 | A | 4/2004 |

OTHER PUBLICATIONS

"Diplomarbeit" (XP-002509372) by Tarmo Kratz et al. which was submitted with the IDS filed on Apr. 1, 2009 with Partial English Translation.

European Search Report dated Jan. 23, 2009 for EP application No. 08166418.7/ Patent No. 2311 Reference No. 02206-08 La/bb "Partial English".

Kratz & Wachwitz: "Diplomarbeit—Entwicklung, Konstruktion, Fertigung und Erprobung des Prototypen eines Wankelmotors fur den Einsatz im Flugmodellbau" (Jul. 1, 1998), Technische Fachhochschule Berlin, XP002509372 "Non-English".

* cited by examiner

*Primary Examiner* — Mary A Davis
(74) *Attorney, Agent, or Firm* — Studebaker & Brackett PC; Donald R. Studebaker

(57) ABSTRACT

A rotary piston engine includes a generally triangular rotor, a pair of side housings, a rotor housing which is assembled with the rotor and the pair of side housings to define three working chambers, an intake port formed in at least one of the side housings, and an exhaust port formed in at least one of the side housings. The length of one side of the triangular face of the rotor is at least 2.4 times the breadth of the rotor.

8 Claims, 8 Drawing Sheets

ROTARY PISTON ENGINE AND METHOD FOR DESIGNING THE SAME

BACKGROUND OF THE INVENTION

1. Field of the Invention

The present invention relates to a rotary piston engine and a method for designing the same.

2. Description of the Prior Art

The rotary piston engine is an engine wherein a generally-triangular rotor is accommodated in a rotor chamber which is formed by a rotor housing having a trochoid inner surface and side housings provided on both sides of the rotor housing. In the rotary piston engine, three working chambers defined by the rotor and the housings move in the circumferential direction as the rotor spins to sequentially passes the intake interval, the compression interval, the expansion interval, and the exhaust interval (see, for example, Japanese Laid-Open Patent Publication No. H5-202761). A rotary piston engine disclosed in this publication has an intake port formed in the side housing and an exhaust port formed in the rotor housing. Namely, this rotary piston engine employs a so-called peripheral exhaust system.

However, the peripheral-exhaust rotary piston engine has such a disadvantage that the intake open timing and the exhaust open timing partially overlap so that a large quantity of residual exhaust gas is carried over into the next interval. Namely, the peripheral-exhaust rotary piston engine has an increased internal EGR (Exhaust Gas Recirculation) quantity. Therefore, to secure stable combustion, the air fuel mixture needs to be richer than the theoretical air fuel ratio (stoichiometric air fuel ratio).

Japanese Laid-Open Patent Publication No. H7-11969 discloses a rotary piston engine employing a so-called side exhaust system wherein the exhaust port is formed in the side housing. This system can eliminate the overlap of the intake open timing and the exhaust open timing. As a result, the residual exhaust gas carried over into the next interval is reduced, and stable combustion is realized even at the theoretical air fuel ratio. As a result, the side-exhaust rotary piston engine achieves smaller fuel consumption than the peripheral-exhaust rotary piston engine.

SUMMARY OF THE INVENTION

As described above, the side-exhaust rotary piston engine has relatively improved fuel efficiency. However, further improvement in fuel efficiency of rotary piston engines is still demanded.

The present invention was conceived in view of the above circumstances. An objective of the present invention is to further improve the fuel efficiency of the rotary piston engine.

The present inventors studied the relationship of the dimensions of the rotary piston engine, especially the dimensions of the rotor in consideration of the objective. The inventor found that parameter L/b (aspect ratio) is a critical parameter for improvement in combustion stability, where L is the length of one side of the generally-triangular face of the rotor (i.e., the longitudinal length of a generally-rectangular flank surface of the rotor) and b is the breadth (the lateral length of the flank surface).

FIG. 6 illustrates the relationship of the rotation variation and the dimension parameter L/b of the rotor at idle (number of revolutions: 820 rpm). In the peripheral exhaust system, as described above, the intake open timing and the exhaust open timing overlap so that the internal EGR quantity increases. As a result, as seen from the phantom line in FIG. 6, the combustion stability with light load deteriorates at the theoretical air fuel ratio (A/F=14.7). To prevent this deterioration, as seen from the solid line with crosses (×) and the solid line with open circles (○) in FIG. 6, the peripheral exhaust system uses an air fuel mixture richer than the theoretical air fuel ratio, specifically, A/F=14.0 or 13.0, to secure stable combustion. With this arrangement, the relationship of the dimension parameter L/b and the rotation variation is not linear.

The side exhaust system can, as described above, eliminate the overlap of the intake open timing and the exhaust open timing and therefore can secure stable combustion even when the air fuel mixture is set to be the theoretical air fuel ratio (see the broken line with solid circles (•) in FIG. 6). When employing the side exhaust system and the theoretical air fuel ratio, the relationship of the dimension parameter L/b and the rotation variation is linear. Therefore, the combustion stability is more improved as the dimension parameter L/b is set to be a larger value. Accordingly, the fuel efficiency is also improved.

The relationship of the dimension parameter L/b and the combustion stability can be explained as follows.

To increase the combustion speed, the rotary piston engine has two spark plugs, one on the trailing side and the other on the leading side, with a predetermined distance therebetween in the rotor rotation directions (in other words, the circumferential directions of the rotor; it should be noted that, in this specification, the "rotor rotation directions" include the direction in which the rotor rotates and the direction opposite to the rotation of the rotor) such that the spark plugs meet a working chamber in the compression interval through the expansion interval. The flames generated by ignition of the trailing side plug and the leading side plug (T-side flame and L-side flame) propagate in both rotor rotation directions and rotor breadth directions. Due to the structure of the rotary piston engine, the speed of propagation of the flames in the rotor rotation directions is relatively high while the speed of propagation of the flames in the rotor breadth directions is relatively low as compared with the propagation speed in the rotor rotation directions.

The T-side flame propagating toward the leading side seen in the direction of the revolution of the rotor and the L-side flame propagating toward the trailing side collide with each other near the midpoint between the two flames. After the collision, combustion of the T-side flame and the L-side flame both attenuate so that the flame propagation speed decreases in both rotor rotation directions and rotor breadth directions.

Now, consider decreasing the dimension parameter L/b on the premise that the rotary piston engine takes the above-described combustion form. Decreasing the dimension parameter L/b while the displacement is maintained constant corresponds to relatively decreasing the length L of one side of the rotor while relatively increasing the breadth b of the rotor. Namely, the rotor has smaller triangular faces but a greater breadth. Decreasing the length L leads to a shorter distance between the trailing side spark plug and the leading side spark plug so that the time between the generation of the T-side and L-side flames and the collision of the flames becomes shorter. Due to the increase in breadth b and the shortened time before the collision of the flames, the collision of the flames occurs before the T-side flame and L-side flame propagating in the rotor breadth directions reach the side housing. After the collision of the both flames, the flame propagation speed decreases, and as a result, the flames do not expand so much in the rotor breadth directions.

On the contrary, consider increasing the dimension parameter L/b. Increasing the dimension parameter L/b while the displacement is maintained constant corresponds to relatively increasing the length L of one side of the rotor while relatively decreasing the breadth b of the rotor. Namely, the rotor has larger triangular faces but a smaller breadth. Increasing the length L leads to a greater distance between the trailing side spark plug and the leading side spark plug so that the time before the collision of the flames becomes longer.

Due to the longer time before the collision of the flames and the decreased breadth b, the T-side flame and L-side flame propagating in the rotor breadth directions reach the side housing before the collision of the flames occurs. After the flames reach the side housing, the pressure in the vicinity of the side housing increases so that the flames are redirected to propagate in the rotor rotation directions. As a result, the propagation of the flames in the rotor rotation directions is enhanced. Thereafter, the T-side flame and L-side flame propagating in the rotor rotation directions collide with each other.

As the combustion stability is improved by increasing the dimension parameter L/b, improvement in the combustion pattern in the working chamber is also expected.

According to one aspect of the present invention, a rotary piston engine includes: a rotor which orbits around an output shaft axis, rotates around an eccentric shaft that is aligned in parallel to and offset from the output shaft axis, and has a generally triangular face as seen in the axial direction; a pair of side housings which are arranged at both axial sides of the rotor to be in contact with side seals of the rotor; a rotor housing which accommodates the rotor therein such that an inner surface of the rotor housing is in contact with apex seals of the rotor, the rotor, the pair of side housings and the rotor housing defining three working chambers; an intake port formed in at least one of the side housings to be capable of communicating to one of the working chambers to induct air into the working chamber; and an exhaust port formed in at least one of the side housings to be capable of communicating to one of the working chambers to exhaust combusted exhaust gas from the working chamber.

The length of one side of the triangular face of the rotor (L) is at least 2.4 times the breadth of the rotor (b).

With this structure, as described above, using a relatively large dimension parameter L/b ($L/b \geqq 2.4$) leads to an improvement in combustion pattern so that the combustion stability is also improved.

As described above, increasing the dimension parameter L/b while the displacement is maintained constant corresponds to increasing the length L while decreasing the breadth b, hence corresponding to a more elongated shape of the working chamber. Therefore, the surface/volume ratio (S/V ratio) of the working chamber over the compression interval and the combustion interval decreases. This leads to an improvement in thermal efficiency so that the fuel efficiency is further improved.

The breadth b of the rotor is preferably 76 mm or less. With this setting, the decrease of the propagation speed of the flames in the rotor breadth directions is prevented. More preferably, the breadth b of the rotor is 70 mm or less. With this setting, the decrease of the propagation speed of the flames is prevented not only in the rotor breadth directions but also in the rotor rotation directions.

The rotary piston engine may further includes a pair of spark plugs installed in the rotor housing and aligned substantially in the circumferential direction of the rotor, the pair of spark plugs being apart from each other by a distance at least 0.7 times the breadth of the rotor.

With a relatively large separation between the pair of spark plugs, a longer time passes before the collision of two flames. As a result, the combustion pattern is improved so that the combustion stability is also improved.

In one preferable embodiment, the inner surface of the rotor housing is a generally oval, trochoid inner surface which is defined by longer and shorter axes perpendicular to each other; one of the pair of spark plugs is provided on one side of the shorter axis within an area ranging from the shorter axis by a distance equal to a half of a length of one side of the triangular face of the rotor; and the other one of the pair of spark plugs is provided on the other side of the shorter axis within an area ranging from the shorter axis by a distance equal to a half of a length of one side of the triangular face of the rotor. With such arrangements, the positions of the spark plugs are optimized.

Preferably, the ratio of air and fuel supplied to the working chambers is set to be a theoretical air fuel ratio. As described above, the relationship of the dimension parameter L/b and the rotation variation is linear only when the rotary piston engine is of a side exhaust type and the air fuel mixture is set to be the theoretical air fuel ratio.

According to another aspect of the present invention, a rotary piston engine includes: a rotor which orbits around an output shaft axis, rotates around an eccentric shaft that is aligned in parallel to and offset from the output shaft axis, and has a generally triangular face as seen in the axial direction; a pair of side housings which are arranged at both axial sides of the rotor to be in contact with side seals of the rotor; a rotor housing which accommodates the rotor therein such that an inner surface of the rotor housing is in contact with apex seals of the rotor, the rotor, the pair of side housings and the rotor housing defining three working chambers; an intake port formed in at least one of the side housings to be capable of communicating to one of the working chambers to induct air into the working chamber; an exhaust port formed in at least one of the side housings to be capable of communicating to one of the working chambers to exhaust combusted exhaust gas from the working chamber; and a pair of spark plugs installed in the rotor housing and aligned substantially in the circumferential direction of the rotor, wherein the pair of spark plugs being apart from each other by a distance at least 0.7 times the breadth of the rotor.

The distance between the pair of spark plugs may be 48 mm or greater. The distance between the pair of spark plugs may be 60 mm or greater.

According to still another aspect of the present invention, there is provided a method for designing a rotary piston engine that includes a rotor which orbits around an output shaft axis, rotates around an eccentric shaft that is aligned in parallel to and offset from the output shaft axis, and has a generally triangular face as seen in the axial direction, a pair of side housings which are arranged at both axial sides of the rotor to be in contact with side seals of the rotor, a rotor housing which accommodates the rotor therein such that an inner surface of the rotor housing is in contact with apex seals of the rotor, the rotor, the pair of side housings and the rotor housing defining three working chambers, an intake port formed in at least one of the side housings to be capable of communicating to one of the working chambers to induct air into the working chamber, and an exhaust port formed in at least one of the side housings to be capable of communicating to one of the working chambers to exhaust combusted exhaust gas from the working chamber.

The designing method includes the steps of: determining a length of one side of the triangular face of the rotor; and determining a breadth of the rotor such that the length of one side of the triangular face of the rotor is at least 2.4 times a breadth of the rotor.

The designing method may further include the step of determining a maximum permissible number of revolutions of the rotor, wherein the length of one side of the triangular face of the rotor is determined based on the maximum permissible number of revolutions such that the length of one side of the triangular face of the rotor is greater as the maximum permissible number of revolutions is smaller.

Increasing the length of one side of the generally triangular face of the rotor means that the size of the rotor is accordingly increased. As a result, the sliding speed of each apex of the rotor to which the apex seal is attached is increased. Therefore, the restriction on the sliding speed then defines the maximum permissible number of revolutions of the rotor. Thus, the upper limit of the length of one side of the triangular face of the rotor may be defined by its maximum permissible number of revolutions.

The rotary piston engine may further include a pair of spark plugs installed in the rotor housing and aligned substantially in the circumferential direction of the rotor; and the method may further include the step of determining the distance between the pair of spark plugs to be at least 0.7 times the breadth of the rotor.

According to still another aspect of the present invention, there is provided a method for designing a rotary piston engine that includes a rotor which orbits around an output shaft axis, rotates around an eccentric shaft that is aligned in parallel to and offset from the output shaft axis, and has a generally triangular face as seen in the axial direction, a pair of side housings which are arranged at both axial sides of the rotor to be in contact with side seals of the rotor, a rotor housing which accommodates the rotor therein such that an inner surface of the rotor housing is in contact with apex seals of the rotor, the rotor, the pair of side housings and the rotor housing defining three working chambers, an intake port formed in at least one of the side housings to be capable of communicating to one of the working chambers to induct air into the working chamber, an exhaust port formed in at least one of the side housings to be capable of communicating to one of the working chambers to exhaust combusted exhaust gas from the working chamber, and a pair of spark plugs installed in the rotor housing and aligned substantially in the circumferential direction of the rotor.

The designing method includes the steps of: determining a breadth of the rotor; and determining the distance between the pair of spark plugs to be at least 0.7 times the breadth of the rotor.

DESCRIPTION OF THE PREFERRED EMBODIMENTS

Figure 1:
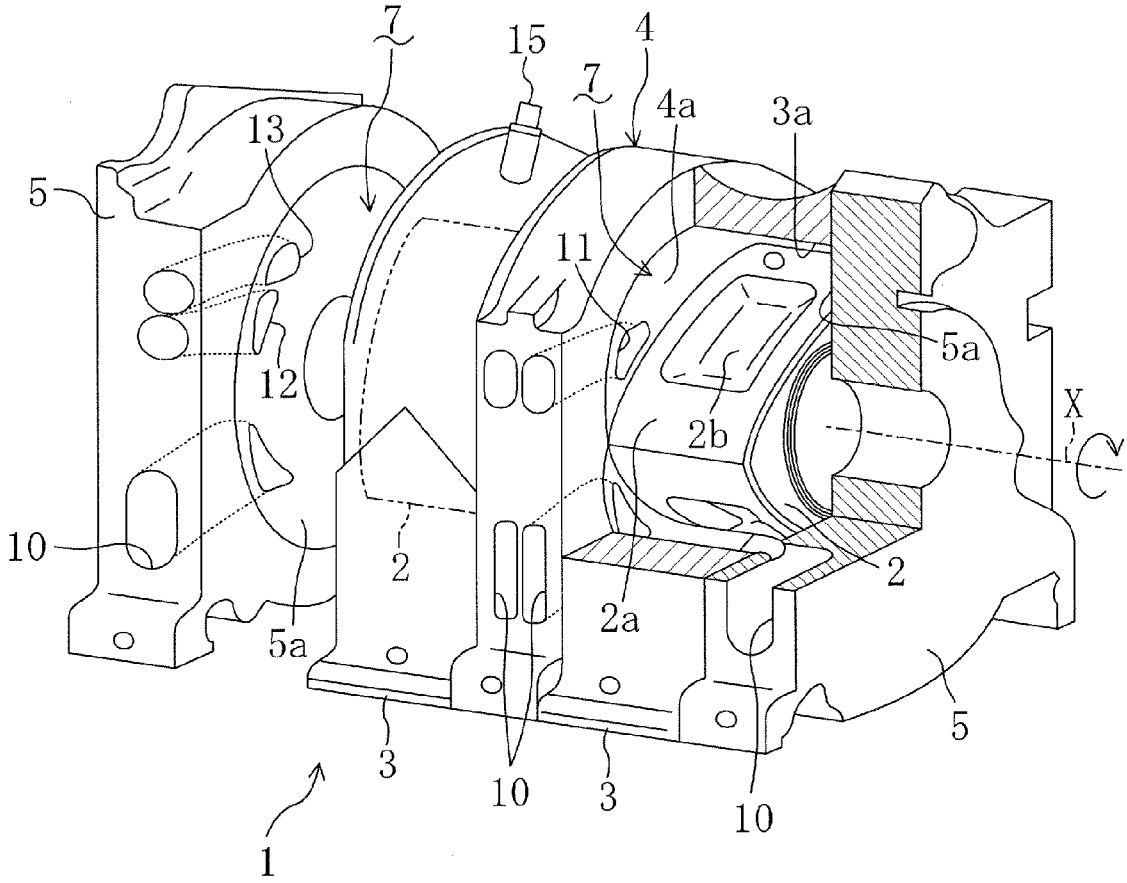
FIG. 1 is a perspective view showing a general structure of a rotary piston engine according to an embodiment of the present invention.
Figure 2:
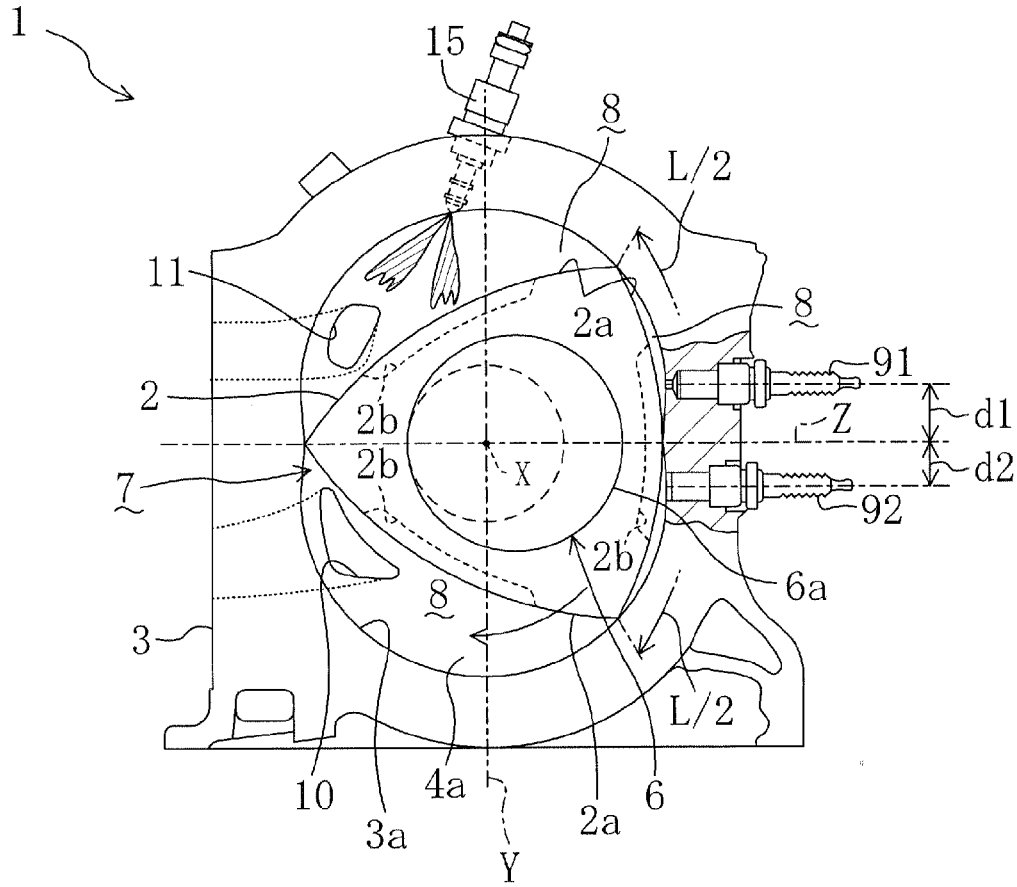
FIG. 2 is a cross-sectional view showing a principal portion of the engine of FIG. 1, part of which is simplified.

FIG. 1 and FIG. 2 show a rotary piston engine 1 according to an embodiment of the present invention (hereinafter, simply referred to as "engine 1"). This engine 1 is of a two rotor type, which includes two rotors 2. The engine 1 further includes two rotor housings 3, an intermediate housing (side housing) 4 interposed between the rotor housings 3, and two other side housings 5 at both sides sandwiching the rotor housings 3, which are integrated into a structure as shown in the drawings. It should be noted that, in FIG. 1, part of the structure on the right-hand side is partially exploded such that the interior can be seen, and the side housing 5 on the left-hand side is separated such that the interior can be seen. In the drawings, "X" denotes the rotation axis (output shaft axis) which is equivalent to the axial center of an eccentric shaft 6.

The rotor housings 3 each have a trochoid inner surface 3*a* which is defined by parallel trochoid curves. The side housings 5 have inner surfaces 5*a* facing on the rotor housings 3 at both sides. The intermediate housing 4 has inner surfaces 4*a* at both sides. The trochoid inner surfaces 3*a* of the rotor housings 3, the inner surfaces 5*a* of the side housing 5, and the inner surfaces 4*a* of the intermediate housing 4 form two rotor chambers 7 provided side by side, each rotor chamber 7 having a generally oval shape like a cocoon when seen in the direction of the rotation axis X as shown in FIG. 2. Each of the rotor chambers 7 accommodates one rotor 2. The rotor chambers 7 are symmetrically positioned about the intermediate housing 4 and have the same structure except for the position and phase of the rotors 2. Hence, one of the rotor chambers 7 is described below.

The rotor 2 is formed by a generally-triangular block, each side of which has a bulge at its central part when seen in the direction of the rotation axis X. The rotor 2 has, along its circumference, three generally-rectangular flank surfaces 2*a* between apexes. Each flank surface 2*a* has, in its central part, a recess 2*b* elongated in the longitudinal direction of the flank surface 2*a*.

The rotor 2 has apex seals (not shown) on its respective apexes. These apex seals are in slidable contact with the trochoid inner surface 3*a* of the rotor housing 3. The trochoid inner surface 3*a* of the rotor housing 3, the inner surface 4*a* of the intermediate housing 4, the inner surface 5*a* of the side housing 5, and the flank surfaces 2*a* of the rotor 2 define three working chambers 8 inside the rotor chamber 7.

The rotor 2 has a phase gear (not shown) in its inside. Specifically, an internal gear (rotor gear) inside the rotor 2 meshes with an external gear (fixed gear) on the side of the side housing 5, and the rotor 2 is supported on the eccentric shaft 6 penetrating through the intermediate housing 4 and the side housing 5 such that the rotor 2 makes a sun-and-planet motion relative to the eccentric shaft 6.

That is, the rotational movement of the rotor 2 is defined by the intermeshing of the internal gear and the external gear.

The rotor 2 spins around an eccentric 6*a* of the eccentric shaft 6 with the three seal portions being in slidable contact with the trochoid inner surface 3*a* of the rotor housing 3 while it orbits around the rotation axis X in the same direction as the spin of the rotor 2 (herein, the spin and the orbital movement of the rotor are generically referred to as "rotation of the rotor"). As the rotor 2 makes one rotation, the three working chambers 8 move in the circumferential direction while each working chamber 8 goes through the intake, compression, expansion (combustion), and exhaust operations, which respectively correspond to the intake stroke, the compression stroke, the expansion (combustion) stroke, and the exhaust stroke of the reciprocating engine. A series of these operations generates rotational force, which is output from the eccentric shaft 6 via the rotor 2.

More specifically, referring to FIG. 2, the rotor 2 rotates clockwise as shown by the arrow. The half of the rotor chamber 7 on the left of the longer axis Y of the rotor chamber 7 passing through the rotation axis X generally serves for the intake and exhaust operations, and the other half on the right of the longer axis Y generally serves for the compression and expansion operations.

The working chamber 8 shown at the upper left in FIG. 2 is in the intake interval where air taken in the working chamber 8 and fuel injected into the working chamber 8 are mixed to prepare an air fuel mixture (hereinafter, a working chamber in this stage is also referred to as "intake working chamber 8"). When the working chamber 8 shifts to the compression interval as the rotor 2 rotates, the air fuel mixture is compressed inside the working chamber 8. Thereafter, the working chamber 8 shown at the right in FIG. 2 undergoes ignition by spark plugs 91 and 92 at predetermined timings within a period from the trail end of the compression interval to the expansion interval to perform a combustion-expansion operation (hereinafter, a working chamber in this stage is also referred to as "compression-expansion working chamber 8"). Then, the working chamber 8 shown at the lower left in FIG. 2 which is in the exhaust interval (hereinafter, a working chamber in this stage is also referred to as "exhaust working chamber 8"). The combusted gas is exhausted via an exhaust port 10 before the working chamber 8 again enters the intake interval and then the subsequent intervals as previously described.

The top of the rotor housing 3 corresponding to the longer axis Y of the rotor housing 3 is provided with an injector (fuel injection valve) 15. The injector 15 is installed so as to face on the intake working chamber 8, such that the injector 15 can directly inject fuel in the intake working chamber 8.

The intake working chamber 8 is in communication with a plurality of intake ports 11, 12 and 13. Specifically, the intermediate housing 4 has the first intake port 11 opened in the inner surface 4*a* facing on the intake working chamber 8 at a position closer to the shorter axis Z on the outer perimeter side of the rotor chamber 7. Also, as shown in FIG. 1, the side housing 5 has the second intake port 12 and the third intake port 13 opened in the inner surface 5*a* facing on the intake working chamber 8 at positions closer to the shorter axis Z on the outer perimeter side of the rotor chamber 7 such that the second intake port 12 and the third intake port 13 face toward the first intake port 11.

For example, at lower rotation speeds of the engine 1, air is basically taken in only through the first intake port 11. As the air-intake becomes deficient, air is also taken in through the second intake port 12 (medium rotation speeds). As the air-intake becomes further deficient, air is also taken in through the third intake port 13 (higher rotation speeds). Namely, an optimum intake-air flow rate is maintained even when the air-intake is varied so that the air is taken in efficiently throughout the whole operation range of the engine 1 from "smaller loads/lower revolution speeds" to "larger loads/higher revolution speeds".

At a side of the rotor housing 3, the T-side spark plug 91 and the L-side spark plug 92 are respectively provided at a trailing side (retarding side) position and a leading side (advancing side) position as seen in the direction of rotation of the rotor with the shorter axis Z extending therebetween. These two spark plugs 91 and 92 meet the compression-expansion working chamber 8. The air fuel mixture in the compression-expansion working chamber 8 is ignited by the spark plugs 91 and 92 simultaneously or with a predetermined phase difference. With the two spark plugs 91 and 92, the combustion speed is improved in the compression-expansion working chamber 8 having an oblate shape. Now, consider that the T-side spark plug 91 is separated from the shorter axis Z by d1, and the L-side spark plug 92 is separated from the shorter axis Z by d2. The T-side spark plug 91 is provided within an area ranging from the shorter axis Z by a distance equal to a half of the length L of one side of the rotor 2 as shown in FIG. 2. The L-side spark plug 92 is also provided within an area ranging from the shorter axis Z by a distance equal to a half of the length L of one side of the rotor 2. With such positions, the T-side spark plug 91 and the L-side spark plug 92 can access the compression-expansion working chamber 8.

The exhaust working chamber 8 is in communication with a plurality of exhaust ports 10. Specifically, the intermediate housing 4 has the exhaust ports 10 opened in the inner surface 4*a* facing on the exhaust working chamber 8 at positions closer to the shorter axis Z on the outer perimeter side of the rotor chamber 7. Also, as shown in FIG. 1, the side housing 5 has the exhaust ports 10 opened in the inner surface 5*a* facing on the exhaust working chamber 8 such that the exhaust ports 10 of the side housing 5 face toward the exhaust ports 10 of the intermediate housing 4. The engine 1 shown in FIG. 1 and FIG. 2 employs such a so-called side exhaust system, wherein the position and shape of the openings of the exhaust ports 10 are designed such that the intake open timing and the exhaust open timing do not overlap. With such a design, the residual exhaust gas carried over into the next interval is reduced, and as a result, the combustion stability is improved even when the air fuel mixture is leaner. Thus, in this engine 1, the air-fuel ratio of the air fuel mixture can be set to be the theoretical air fuel ratio.

Figure 3:
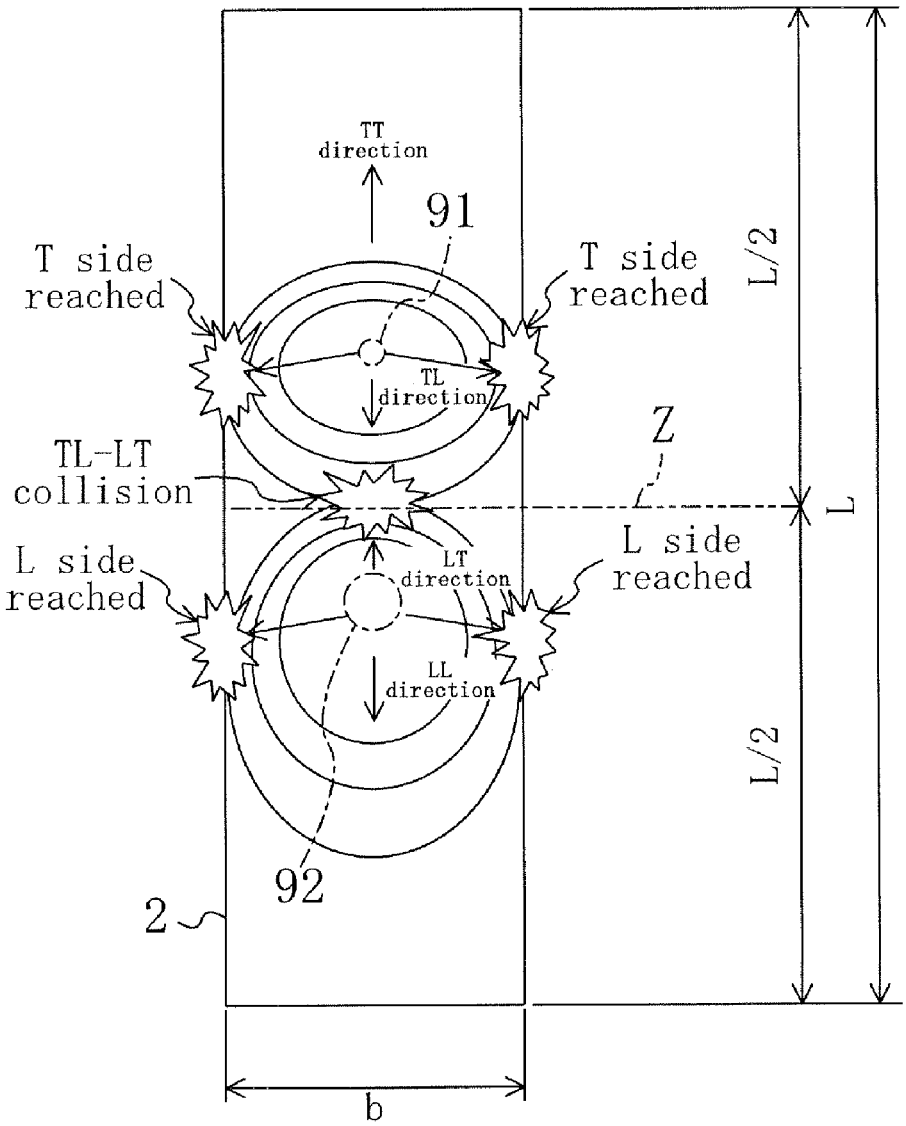
FIG. 3 is a general side view illustrating the details of the dimensions of a rotor.

The features of the engine 1 of this embodiment reside in that the generally-rectangular rotor 2 has relatively large triangular faces while the breadth of the rotor 2 is relatively small. Specifically, referring to FIG. 3 (FIG. 3 is a side view of the rotor plotted in the rotor coordinate system), the length L of one side of the rotor 2 is relatively large while the breadth b of the rotor 2 is relatively small so that the dimension parameter L/b, consisting of length L and breadth b, is larger than that of the conventional rotor. With this arrangement, the engine 1 achieves improved combustion stability and improved thermal efficiency so that the fuel consumption is ameliorated. The reasons for these improvements are described below.

Figure 4:
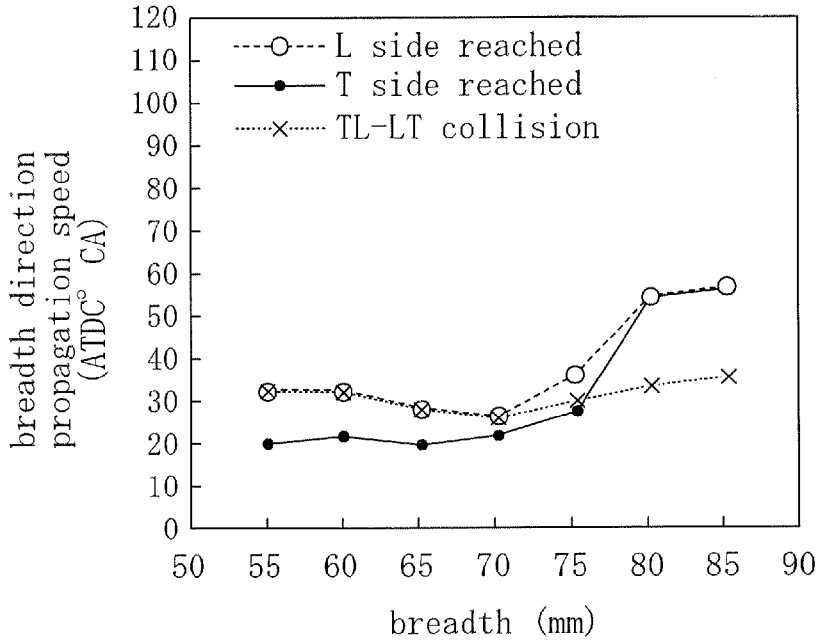
FIG. 4 illustrates the relationship of the flame propagation speed in the rotor breadth directions and the breadth of the rotor.

FIG. 4 illustrates the variation of the flame propagation speed in the rotor breadth directions with varying breadth b of the rotor 2 where the abscissa represents the breadth b (mm) of the rotor 2, and the ordinate represents the eccentric angle (° C.A). Note that the eccentric angle means a rotation angle in the rotation direction of the eccentric shaft 6 relative to the state where the volume of the compression-expansion working chamber 8 is minimum (top dead center: TDC).

In FIG. 4, the broken line with open circles (o) represents the eccentric angle when the flame generated by ignition with the L-side spark plug 92 (L-side flame) propagating in the rotor breadth directions reaches the side housing 5 (or the intermediate housing 4), i.e., the far end of the rotor breadth dimension of the working chamber 8. The solid line with solid circles (•) in FIG. 4 represents the eccentric angle when the flame generated by ignition with the T-side spark plug 91 (T-side flame) propagating in the rotor breadth directions reaches the side housing 5. The broken line with crosses (×) in FIG. 4 represents the eccentric angle at the time of collision of the L-side flame propagating toward the trailing side in the rotor rotation direction (LT direction in FIG. 3) and the T-side flame propagating toward the leading side in the rotor rotation direction (TL direction).

As seen from FIG. 4, with the breadth b of the rotor 2 being 76 mm or less, the eccentric angle when the T-side flame reaches the side housing 5 and the eccentric angle when the L-side flame reaches the side housing 5 are equal to or smaller than the eccentric angle at the time of collision of the L-side flame and the T-side flame. With the breadth b of the rotor 2 being more than 76 mm, the eccentric angle at the time of collision of the L-side flame and the T-side flame is smaller than the eccentric angles when the T-side flame and the L-side flame reach the side housing 5. A conceivable reason for this is that, as the breadth b of the rotor 2 is increased, the time before the T-side flame and the L-side flame propagating in the rotor breadth directions reach the side housing 5 is increased accordingly so that the collision of the L-side flame and the T-side flame occurs before the L-side flame and the T-side flame reach the side housing 5. As a result, the combustion is attenuated so that the probability of the flames reaching the side housing 5 is decreased. Thus, in view of the purpose of preventing the decrease of the flame propagation speed in the rotor breadth directions, the breadth b of the rotor 2 is preferably 76 mm or less.

Figure 5:
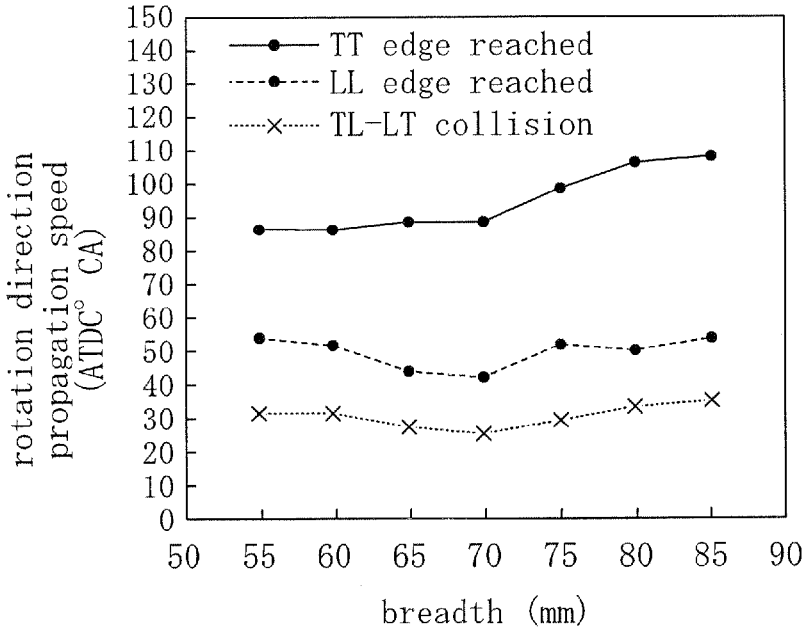
FIG. 5 illustrates the relationship of the flame propagation speed in the rotor rotation directions and the breadth of the rotor.

FIG. 5 illustrates the variation of the flame propagation speed in the rotor rotation directions with varying breadth b of the rotor 2 where the abscissa represents the breadth b (mm) of the rotor 2, and the ordinate represents the eccentric angle (° C.A). The solid line with solid circles (•) in FIG. 5 represents the eccentric angle when the T-side flame propagating to the trailing side in the rotor rotation direction (TT direction in FIG. 3) reaches the edge of the rotor 2. The broken line with solid circles (•) in FIG. 5 represents the eccentric angle when the L-side flame propagating to the leading side in the rotor rotation direction (LL direction) reaches the edge of the rotor 2. The broken line with crosses (×) in FIG. 5 represents the eccentric angle at the time of collision of the L-side flame and the T-side flame in the rotor rotation directions.

As seen from FIG. 5, with the breadth b of the rotor 2 being 70 mm or less, the eccentric angle when the T-side flame reaches the trailing side edge of the rotor 2 and the eccentric angle when the I-side flame reaches the leading side edge of the rotor 2 are generally constant. Especially with the breadth b of the rotor 2 being more than 70 mm, the eccentric angle when the T-side flame reaches the trailing side edge of the rotor 2 increases as the breadth b increases. A conceivable reason for this is that, when the T-side flame and the L-side flame reach the side housing 5 before the collision of the T-side flame and the L-side flame, the flames are redirected to propagate in the rotor rotation directions due to the increase in pressure in the vicinity of the side housing 5 so that the propagation of the flames in the rotor rotation directions is enhanced; but when the T-side flame and the L-side flame collide with each other before the T-side flame and the L-side flame reach the side housing 5 so that the combustion is attenuated, the propagation of the flames in the rotor rotation directions is not enhanced so that the propagation of the T-side flame toward the trailing side is especially delayed. Thus, in view of the purpose of preventing the decrease of the flame propagation speed in the rotor rotation directions, the breadth b of the rotor 2 is preferably 70 mm or less.

The rotary piston engines of Examples 1-5, Conventional Example, and Comparative Examples 1 and 2, whose dimensions are shown in TABLE 1, are now compared. Examples 1-5 have dimension parameters L/b of 2.4 or more. Conventional Example has a longer rotor breadth b and a shorter length L than Example 1 and has a dimension parameter L/b smaller than 2.4. Comparative Examples 1 and 2 have longer breadth b than Conventional Example and has a dimension parameter L/b smaller than 2.4.

TABLE 1 shows the position parameter d/b which is defined in each of Examples 1-5, Conventional Example, and Comparative Examples 1 and 2. The position parameter d/b consists of the distance between a pair of spark plugs 91 and 92, d (=d1+d2), and the rotor breadth b, i.e., the breadth of the rotor housing 3. Examples 1-4 have position parameters d/b of 0.7 or more. In Conventional Example and Comparative Examples 1 and 2, the distance between the spark plugs 91 and 92 is shorter than that of Example 1, and the position parameter d/b is smaller than 0.7.

TABLE 1

| | Length of one side of rotor L (mm) | Rotor breadth b (mm) | L/b | Distance between trailing plug and shorter axis d1 (mm) | Distance between leading plug and shorter axis d2 (mm) | Distance between plugs d (=d1 + d2) (mm) | d/b |
|---|---|---|---|---|---|---|---|
| Example 3 | 208 | 60 | 3.47 | 31 | 29 | 60 | 1.00 |
| Example 2 | 182 | 60 | 3.03 | 30 | 18 | 48 | 0.80 |
| Example 1 | 208 | 76 | 2.74 | 34 | 26 | 60 | 0.79 |
| Example 4 | 222 | 85 | 2.61 | 40 | 33 | 73 | 0.86 |
| Example 5 | 182 | 70 | 2.60 | 30 | 18 | 48 | 0.69 |
| Conventional | 182 | 80 | 2.28 | 30 | 23 | 53 | 0.66 |
| Comparative 2 | 182 | 90 | 2.02 | 30 | 23 | 53 | 0.59 |
| Comparative 1 | 182 | 100 | 1.82 | 30 | 23 | 53 | 0.53 |

Figure 6:
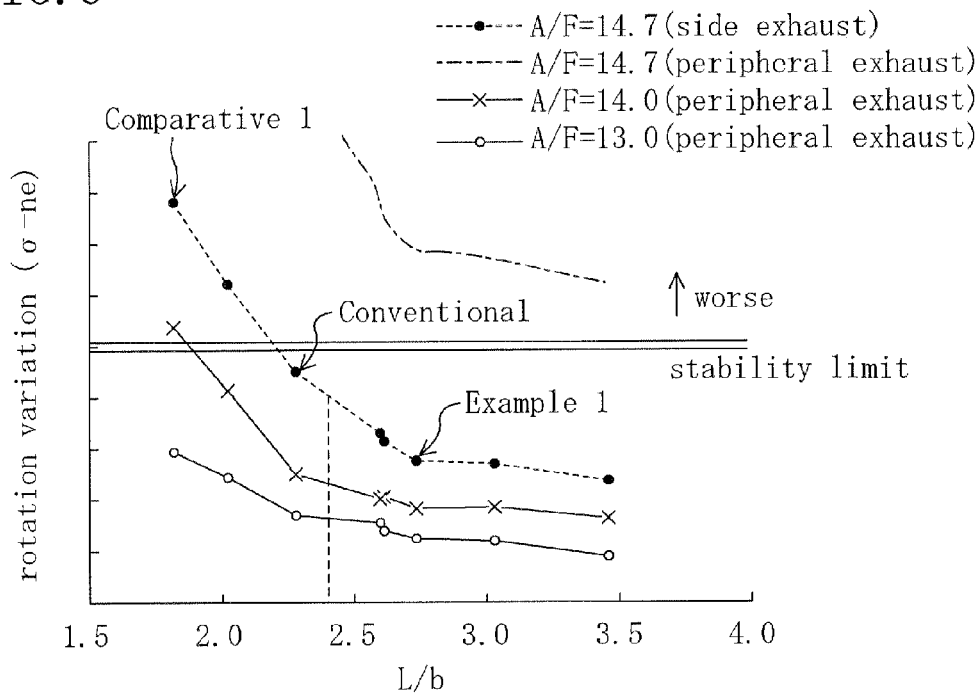
FIG. 6 illustrates the relationship of the rotation variation and the dimension parameter L/b.

FIG. 6 illustrates the rotation variation (σ-ne) at idle (number of revolutions: 820 rpm) relative to the dimension parameter L/b of the rotor.

In a conventional peripheral-exhaust engine, the overlap of the intake open timing and the exhaust open timing occurs as previously described, and therefore, the air fuel ratio is set richer than the theoretical air fuel ratio to secure stable combustion (refer to the solid line with crosses (×) and the solid line with open circles (○) in FIG. 6). With this setting, the relationship of the dimension parameter L/b and the rotation variation is not linear.

In a side-exhaust engine such as an engine of the present embodiment where no overlap of the intake open timing and the exhaust open timing occurs, the combustion stability can be secured even though the air fuel mixture is set to be the theoretical air fuel ratio so that the air fuel mixture is leaner than the conventional example (refer to the broken line with solid circles (•) in FIG. 6). With this setting, the relationship of the dimension parameter L/b and the rotation variation is linear. With a greater dimension parameter L/b, the engine operation is further away from the stability limit. Namely, with a greater dimension parameter L/b, the combustion becomes more stable. As seen from FIG. 6, in view of the purpose of securing sufficient combustion stability, the dimension parameter L/b is preferably 2.4 or more.

Figure 7:
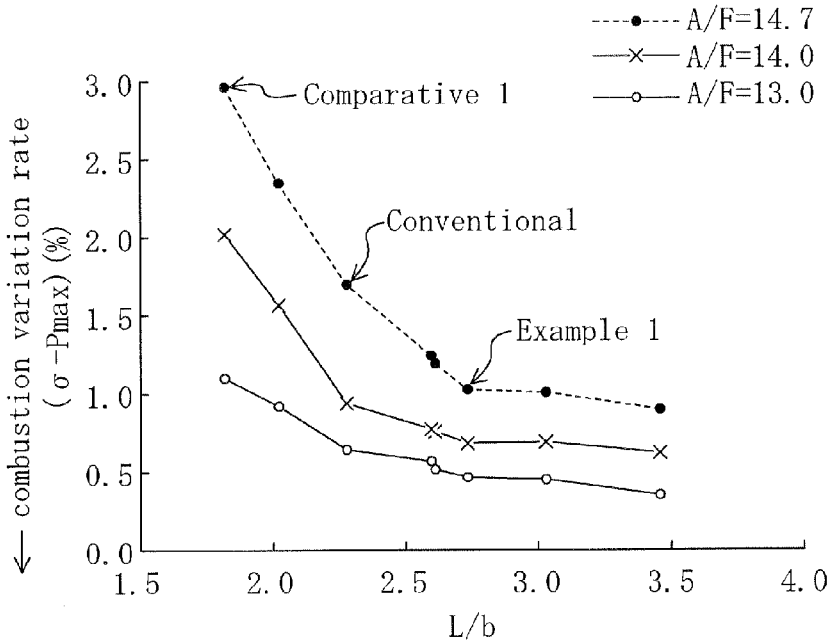
FIG. 7 illustrates the relationship of the combustion variation rate and the dimension parameter L/b.

FIG. 7 illustrates the combustion variation rate (σ-Pmax) relative to the dimension parameter L/b. The operation state of the engine 1 was compared in a relatively low RPM and small load condition; specifically, the number of revolutions: 2000 rpm, BMEP (Brake Mean Effective Pressure): 294 kPa. As for this parameter also, as described above, in a side-exhaust engine such as an engine of the present embodiment where the air fuel mixture is set to be the theoretical air fuel ratio, the relationship of the dimension parameter L/b and the combustion variation rate is linear (refer to the broken line with solid circles (•) in FIG. 7). Namely, increasing the parameter L/b leads to more stable combustion.

Figure 8:
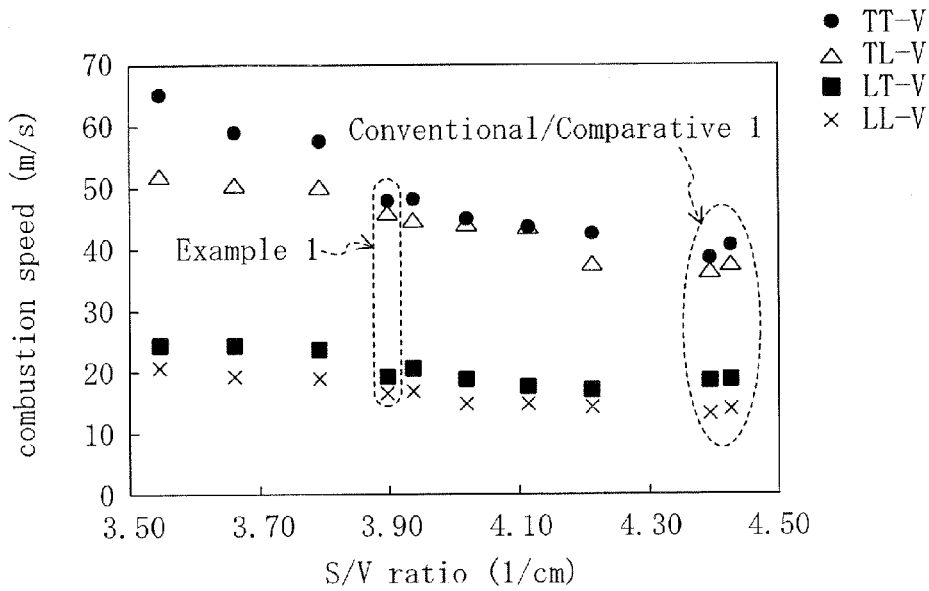
FIG. 8 illustrates the relationship of the combustion speed in the rotor rotation directions and the S/V ratio.

FIG. 8 illustrates the variation of the combustion speed in the rotor rotation directions relative to the surface/volume ratio (S/V ratio) at the TDC. In FIG. 8, solid circles (•) represent the combustion speed of T-side flame in the trailing side direction (TT direction in FIG. 3), open triangles (Δ) represent the combustion speed of T-side flame in the leading side direction (TL direction), solid boxes (▯) represent the combustion speed of L-side flame in the trailing side direction (LT direction), and crosses (×) represent the combustion speed of L-side flame in the leading side direction (LL direction).

Increasing the dimension parameter L/b geometrically corresponds to decreasing the S/V ratio. As seen from FIG. 8, the flame propagation speed increases especially in TT direction as the S/V ratio decreases. A conceivable reason for this is an improvement in thermal efficiency due to a small S/V ratio.

Figure 9:
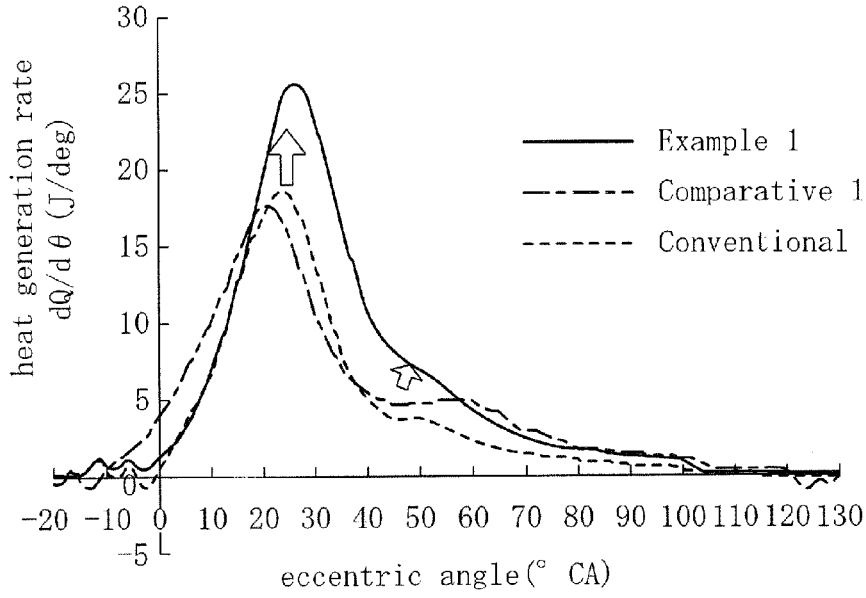
FIG. 9 illustrates the comparison of the heat generation patterns of Example, Comparative Example, and Conventional Example.

FIG. 9 illustrates the comparison of the heat generation patterns of Example 1, Comparative Example 1, and Conventional Example. Herein, the abscissa represents the eccentric angle (° C.A), and the ordinate represents the heat generation rate (dQ/dθ) (J/deg).

As seen from FIG. 9, Conventional Example, represented by broken line, has a smaller peak in heat generation rate, with the heat generation rate sharply decreasing after the peak. Comparative Example 1 (represented by chain line) also has a smaller peak in heat generation rate as Conventional Example does, though the ignition timing is advanced as compared with Conventional Example for the purpose of achieving stable combustion. After the peak, the heat generation rate of Comparative Example 1 is partially slightly higher than Conventional Example in some parts (near the eccentric angle of 60° C.A), where moderate combustion continues.

In comparison, Example 1, represented by solid line, has a heat generation peak much greater than Conventional Example and Comparative Example 1, with relatively high heat generation rate being maintained after the peak (refer to open arrows in FIG. 9). A conceivable reason for this is sufficient propagation of the flames in the rotor breadth directions. The area encompassed by the curve of Example 1 and the abscissa is sufficiently large as compared with Conventional Example and Comparative Example 1, which means Example 1 provides a higher heat generation rate.

Figure 10:
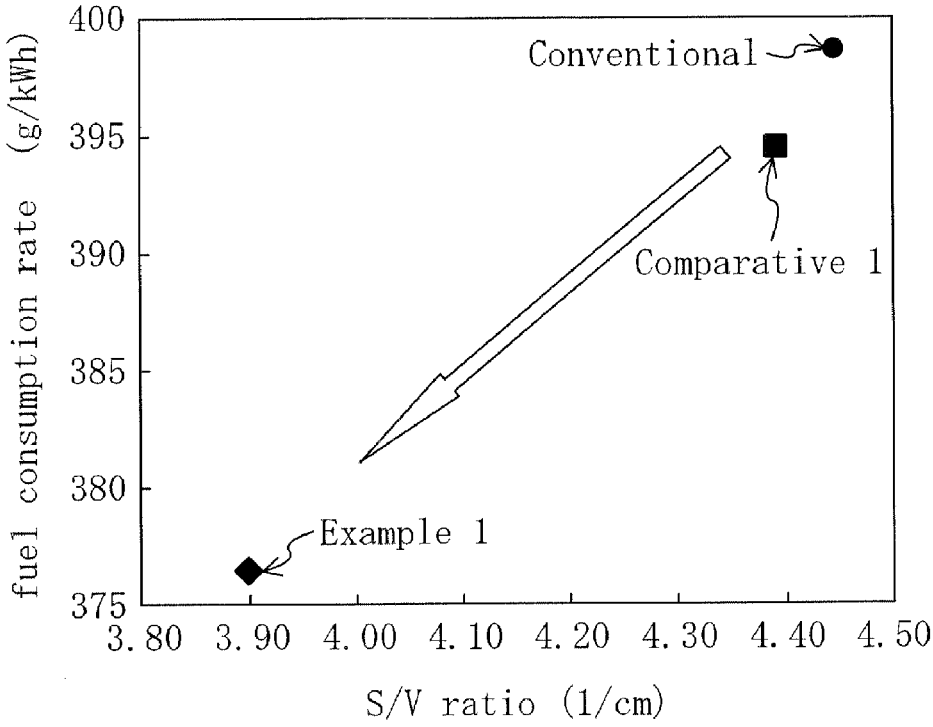
FIG. 10 illustrates the relationship of the fuel consumption rate in the rotor rotation directions and the S/v ratio.

FIG. 10 illustrates the fuel consumption rate of Example 1, Comparative Example 1 and Conventional Example where the abscissa represents the S/V ratio and the ordinate represents the fuel consumption rate. Herein, the fuel consumption rates were compared in a relatively low RPM and small load condition (number of revolutions: 1500 rpm, BMEP: 294 kPa). As seen from FIG. 10, Example 1 achieved an improved fuel consumption rate which is about 5% higher than Comparative Example 1 and Conventional Example (refer to the open arrow of FIG. 10).

Figure 11:
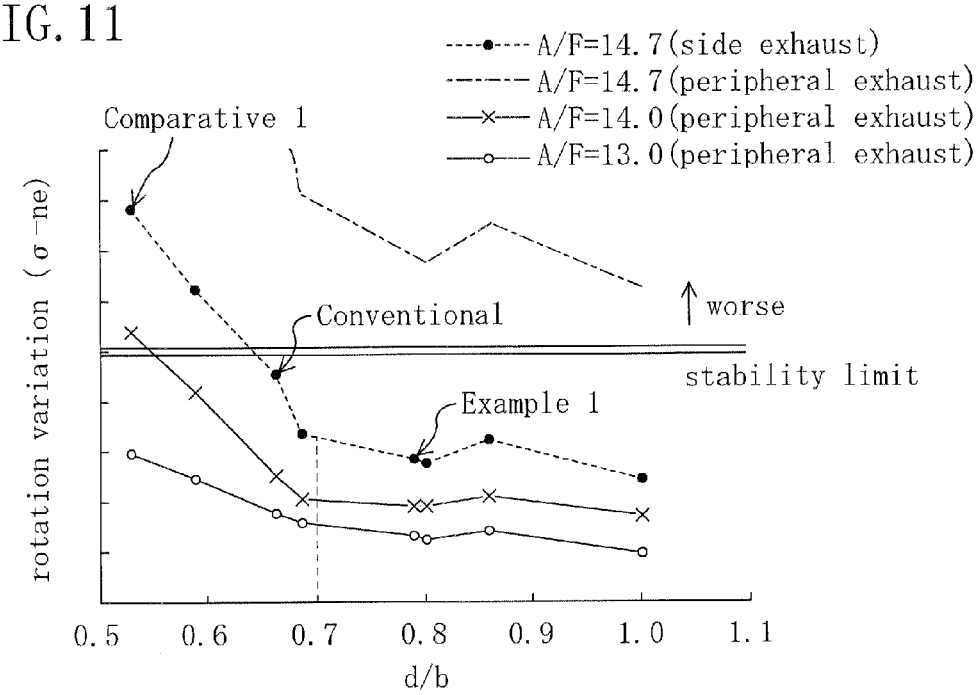
FIG. 11 illustrates the relationship of the rotation variation and the position parameter d/b.
Figure 12:
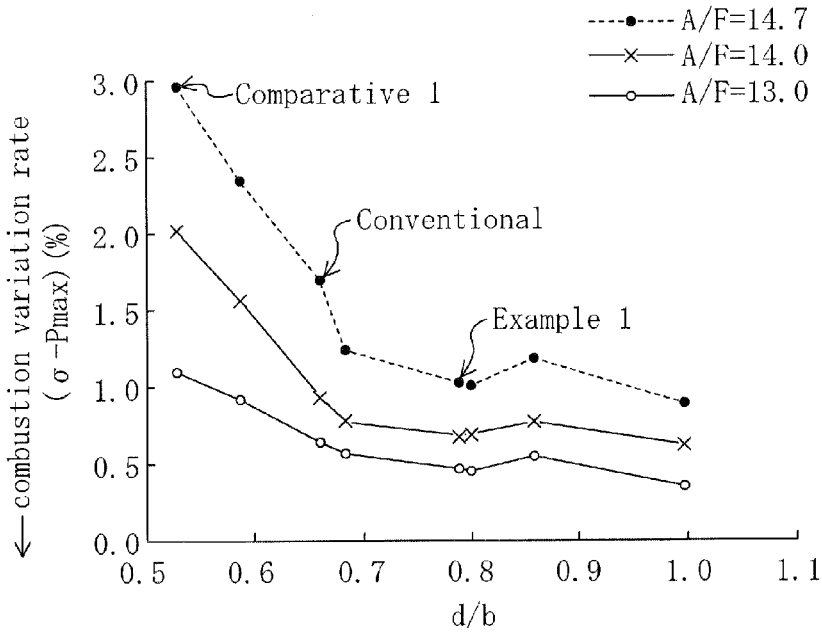
FIG. 12 illustrates the relationship of the combustion variation rate and the position parameter d/b.

FIG. 11 illustrates the rotation variation (σ-ne) at idle (number of revolutions: 820 rpm) relative to the position parameter d/b. FIG. 12 illustrates the combustion variation rate (σ-Pmax) relative to the position parameter d/b, with the conditions that the number of revolutions is 2000 rpm and BMEP is 294 kPa. As seen from these graphs, increasing the position parameter d/b leads to more stable combustion as is the case with the dimension parameter L/b. As seen from FIG. 11, in view of the purpose of securing sufficient combustion stability, the position parameter d/b is preferably 0.7 or more. As seen from TABLE 1, the distance d between the spark plugs 91 and 92 is preferably 48 mm or more, more preferably 60 mm or more.

In summary, a rotary piston engine of this embodiment has a relatively large dimension parameter L/b such that T-side flame and L-side flame propagate sufficiently in the breadth directions of the rotor 2 before the collision of the T-side flame and the L-side flame in the rotor rotation directions. Therefore, the combustion pattern is improved, and accordingly, the combustion stability is also improved.

Increasing the dimension parameter L/b leads to a decrease of the S/V ratio so that the thermal efficiency is improved. The improved thermal efficiency and the improved combustion stability together can serve to greatly improve the fuel consumption of the rotary piston engine 1.

There is another index relating to the combustion stability of the rotary piston engine 1, the position parameter d/b. Increasing the position parameter d/b also leads to an improvement in combustion stability.

The present invention is not limited to the above embodiments but can be implemented in a variety of different forms without departing from the spirit or principal features of the present invention. The above embodiments are merely exemplary in every respects and should not be interpreted limitingly. The extent of the present invention is to be defined only by the claims without being restricted to the disclosures of the specification. Variations and modifications which can be considered as equivalents to the claimed inventions are to be within the scope of the present invention.

What is claimed is:

1. A rotary piston engine comprising:

a rotor which orbits around an output shaft axis, rotates around an eccentric shaft that is aligned in parallel to and offset from the output shaft axis, and has a generally triangular face as seen in the axial direction;

a pair of side housings which are arranged at both axial sides of the rotor to be in contact with side seals of the rotor;

a rotor housing which accommodates the rotor therein such that an inner surface of the rotor housing is in contact with apex seals of the rotor, the rotor, the pair of side housings and the rotor housing defining three working chambers;

an injector attached to the rotor housing, and directly injecting fuel in an intake working chamber;

an intake port formed in at least one of the side housings to be capable of communicating to one of the working chambers to induct air into the working chamber;

an exhaust port formed in at least one of the side housings to be capable of communicating to one of the working chambers to exhaust combusted exhaust gas from the working chamber; and a pair of spark plugs installed in the rotor housing and aligned substantially in the circumferential direction of the rotor, wherein a length of one side of the triangular face of the rotor is at least 2.4 times a breadth of the rotor, and the pair of spark plugs is apart from each other by a distance of at least 0.7 times the breadth of the rotor.

2. The rotary piston engine of claim 1, wherein the breadth of the rotor is 76 mm or less.

3. The rotary piston engine of claim 2, wherein the breadth of the rotor is 70 mm or less.

4. The rotary piston engine of claim 1, wherein:

the inner surface of the rotor housing is a generally oval, trochoid inner surface which is defined by longer and shorter axes perpendicular to each other;

one of the pair of spark plugs is provided on one side of the shorter axis within an area ranging from the shorter axis by a distance equal to a half of a length of one side of the triangular face of the rotor; and the other one of the pair of spark plugs is provided on the other side of the shorter axis within an area ranging from the shorter axis by a distance equal to a half of a length of one side of the triangular face of the rotor.

5. The rotary piston engine of claim 1, wherein the distance between the pair of spark plugs is 48 mm or greater.

6. The rotary piston engine of claim 5, wherein the distance between the pair of spark plugs is 60 mm or greater.

7. The rotary piston engine of claim 1, wherein the ratio of air and fuel supplied to the working chambers is set to be a theoretical air fuel ratio.

8. A method for designing a rotary piston engine, the rotary piston engine including a rotor which orbits around an output shaft axis, rotates around an eccentric shaft that is aligned in parallel to and offset from the output shaft axis, and has a generally triangular face as seen in the axial direction, a pair of side housings which are arranged at both axial sides of the rotor to be in contact with side seals of the rotor, a rotor housing which accommodates the rotor therein such that an inner surface of the rotor housing is in contact with apex seals of the rotor, the rotor, the pair of side housings and the rotor housing defining three working chambers, an injector attached to the rotor housing, and directly injecting fuel in an intake working chamber;

an intake port formed in at least one of the side housings to be capable of communicating to one of the working chambers to induct air into the working chamber, an exhaust port formed in at least one of the side housings to be capable of communicating to one of the working chambers to exhaust combusted exhaust gas from the working chamber, and a pair of spark plugs installed in the rotor housing and aligned substantially in the circumferential direction of the rotor, the method comprising the steps of:

determining a length of one side of the triangular face of the rotor;

determining a breadth of the rotor such that the length of one side of the triangular face of the rotor is at least 2.4 times a breadth of the rotor; and determining the distance between the pair of spark plugs to be at least 0.7 times the breadth of the rotor.

* * * * *